US006715238B2

(12) United States Patent
Zambelli et al.

(10) Patent No.: US 6,715,238 B2
(45) Date of Patent: Apr. 6, 2004

(54) FALL PROTECTING SAFETY DEVICE

(76) Inventors: Sergio Zambelli, Via Stezzano, 28, 24050 Zanica (IT); Benito Zambelli, Via Roma, 44, 24050 Zanica (IT)

( * ) Notice: Subject to any disclaimer, the term of this patent is extended or adjusted under 35 U.S.C. 154(b) by 15 days.

(21) Appl. No.: 10/092,625

(22) Filed: Mar. 8, 2002

(65) Prior Publication Data

US 2002/0148170 A1 Oct. 17, 2002

(30) Foreign Application Priority Data

Apr. 12, 2001 (IT) ..... MI2001A0803

(51) Int. Cl.[7] ..... E04D 13/00

(52) U.S. Cl. ..... 52/24; 52/27; 52/749.12; 52/DIG. 12; 182/3

(58) Field of Search ..... 52/24, 27, 749.12, 52/DIG. 12; 182/3, 112, 113, 39, 45; 248/237

(56) References Cited

U.S. PATENT DOCUMENTS

| | | | | | |
|---|---|---|---|---|---|
| 526,253 | A | * | 9/1894 | Murray | 52/292 |
| 2,980,376 | A | * | 4/1961 | Westerfield | 248/536 |
| 3,880,405 | A | | 4/1975 | Brueske | |
| 4,660,679 | A | * | 4/1987 | Ostrobrod | 182/18 |
| 4,942,943 | A | * | 7/1990 | Flaherty | 182/231 |
| 5,358,068 | A | * | 10/1994 | Whitmer | 182/113 |
| 5,931,424 | A | | 8/1999 | Kerber | |
| 6,336,623 | B1 | * | 1/2002 | McCarthy | 182/113 X |
| 6,412,230 | B1 | * | 7/2002 | Zambelli et al. | 52/27 |
| 2001/0032435 | A1 | * | 10/2001 | Austin | 52/749.12 |
| 2002/0079164 | A1 | * | 6/2002 | Choate | 182/3 X |
| 2003/0051429 | A1 | * | 3/2003 | Hovenier | 182/112 X |

FOREIGN PATENT DOCUMENTS

| | | |
|---|---|---|
| EP | 0 877 131 | 11/1998 |
| EP | 1 083 273 | 3/2001 |

* cited by examiner

*Primary Examiner*—Carl D. Friedman
*Assistant Examiner*—Nahid Amiri
(74) *Attorney, Agent, or Firm*—Guido Modiano; Albert Josif; Daniel O'Byrne

(57) ABSTRACT

A safety device for the building field, for individually protecting against falls workers assigned to walking at high elevations in buildings under construction. The device comprises at least one pole, a detachable connection for the pole base with the surface of a building, the pole having at its top end, an engagement for a cable element forming a safety parapet, at least one leg connected laterally to rest, with its lower end, on the surface of the building, laterally to the region engaged by the base of the pole, to form, for the pole, an auxiliary resting element for pushing against the surface of the building.

24 Claims, 6 Drawing Sheets

FALL PROTECTING SAFETY DEVICE

BACKGROUND OF THE INVENTION

The present invention relates to a safety device for the building field, for individually protecting against falls workers assigned to walking at high elevations in buildings under construction.

Safety devices for buildings are known for providing individual protection against falls of workers assigned to walking at high elevations in buildings under construction.

These devices generally comprise a plurality of metal poles, which are mutually spaced and are connected, at their base, to a horizontal surface of the building, constituted for example by a beam, and have, at their top end or in an intermediate region of their vertical extension, a passage for a cable, which is fixed to the building at its ends and is tensioned by means of suitable cable tensioning elements so as to form a safety parapet.

In these devices, the poles are merely meant to keep the cable at a preset height, so that it is easily engaged by the spring-clips of the safety belts or harnesses worn by workers.

U.S. Ser. No. 09/645,560 by the same Applicants, which is herein included by reference, illustrates a safety device significantly reducing the stresses transmitted from the cable to the pole transversely to the axis of the pole and allows to distribute over multiple poles the stresses transmitted along the cable, thus reducing the stresses discharged onto each pole.

Although this device ensures a better performance than conventional safety devices, it has limitations of application when the spacing between the poles becomes considerable. This device in fact offers adequate assurances of safety, with acceptable dimensions of the pole and of the system for connection to the surface of the building, for pole spacings up to approximately 10 m. When greater spacings are required, in order to work safely it would be necessary to oversize considerably the pole and the insert embedded in the concrete component to which the pole is rigidly coupled. This would inevitably entail an increase in the weight of the device and in its cost. Furthermore, with this device it is technically inadvisable to have pole spacings of more than 10 m, since beyond this limit in operating conditions the forces that become involved are different not only in terms of load but also in terms of multiple traction components: the pole might tip not only in the direction of the cable but also at right angles, since the cable would oscillate laterally. So-called "whiplash", i.e., dynamic stresses that are highly amplified and are composed of forces that are parallel and perpendicular to the line of the cable, causing tipping or oscillations of the poles, might also occur.

Another limit that can be observed in known types of device is the fact that these devices have been conceived mainly to be installed on prefabricated beams, i.e., on components that have a reduced transverse dimension. Because of this, the accidental fall of the worker is very close to the ideal tension line of the cable and therefore produces on the cable a force that has a modest lateral component, which can be withstood easily both by means of the cable and by means of the base for interlocking and resting the pole in and on the beam.

If these safety devices were installed on wider structural elements, such as for example prefabricated concrete floor or covering slabs, the traction components directed laterally to the cable would increase considerably, since any fall of the worker would be laterally quite distant from the ideal tension line of the cable. The cable, by touching the lateral edge of the concrete component, would in fact generate an additional significant lever arm and would introduce a torque and/or flexural moment that are difficult to re-center on the pole.

Moreover, it should be noted that prefabricated slabs (which are usually 10–20 meters long but are sometimes as long as 30 m) are often transported when they are already pre-impermeabilized with bitumen coats, except for the ends where the inserts for facilitating their lifting are inserted.

In such cases it is unfeasible to maintain a limited spacing between the poles, since it would be necessary to pierce the coat at the insert in order to connect the base of the poles.

Particularly for these kinds of components, there is a need to have a safety device for individually protecting against falls workers assigned to walking at high elevations in buildings under construction, which offers adequate assurances of safety even with considerable pole spacings.

SUMMARY OF THE INVENTION

The aim of the present invention is indeed to provide a safety device for the building field, for individually protecting against falls workers assigned to walking at high elevations in buildings under construction which is capable of withstanding forces, even considerable ones, orientated transversely to the line of the cable in the presence of large pole spacings.

Within this aim, an object of the invention is to provide a device that can adapt itself without problems to different operating conditions and to different types of prefabricated component.

Another object of the invention is to provide a device that is simple to use and offers the greatest assurances of safety.

This aim and these and other objects that will become better apparent hereinafter are achieved by a safety device for the building field, for individually protecting against falls workers assigned to walking at high elevations in buildings under construction, which comprises at least one pole and means for detachably connecting the base of said pole to the surface of a building; said pole having, proximate to its top end, engagement means for a cable element that is suitable to form a safety parapet, characterized in that it comprises at least one leg which is connected laterally to said pole and can rest, with its lower end, on said surface of the building, laterally to the region engaged by the base of said pole, in order to form, for said pole, an auxiliary resting element for pushing against said surface of the building.

BIEF DESCRIPTION OF THE DRAWINGS

Further characteristics and advantages of the invention will become better apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
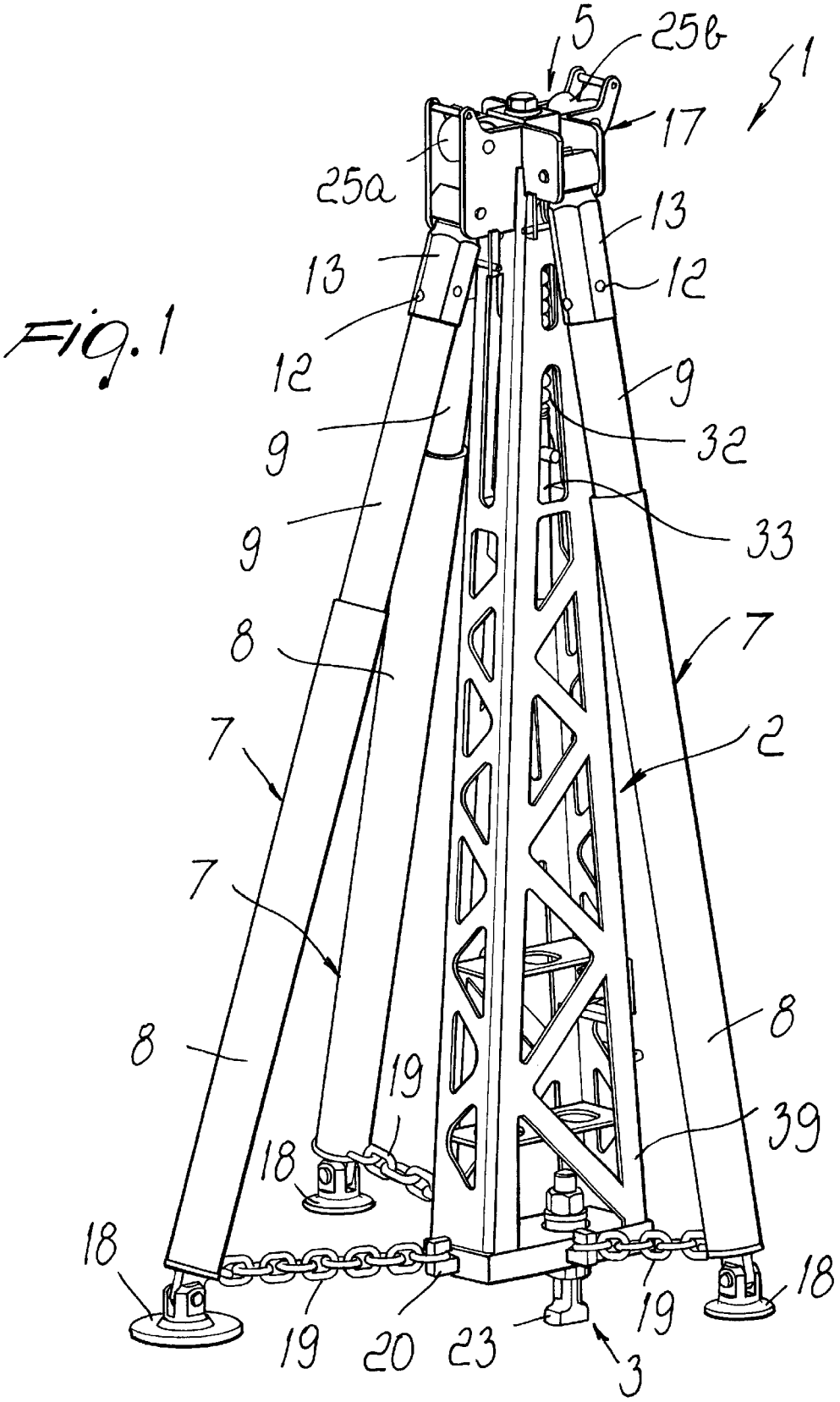
FIG. 1 is a perspective view of the device according to the invention.
Figure 3:
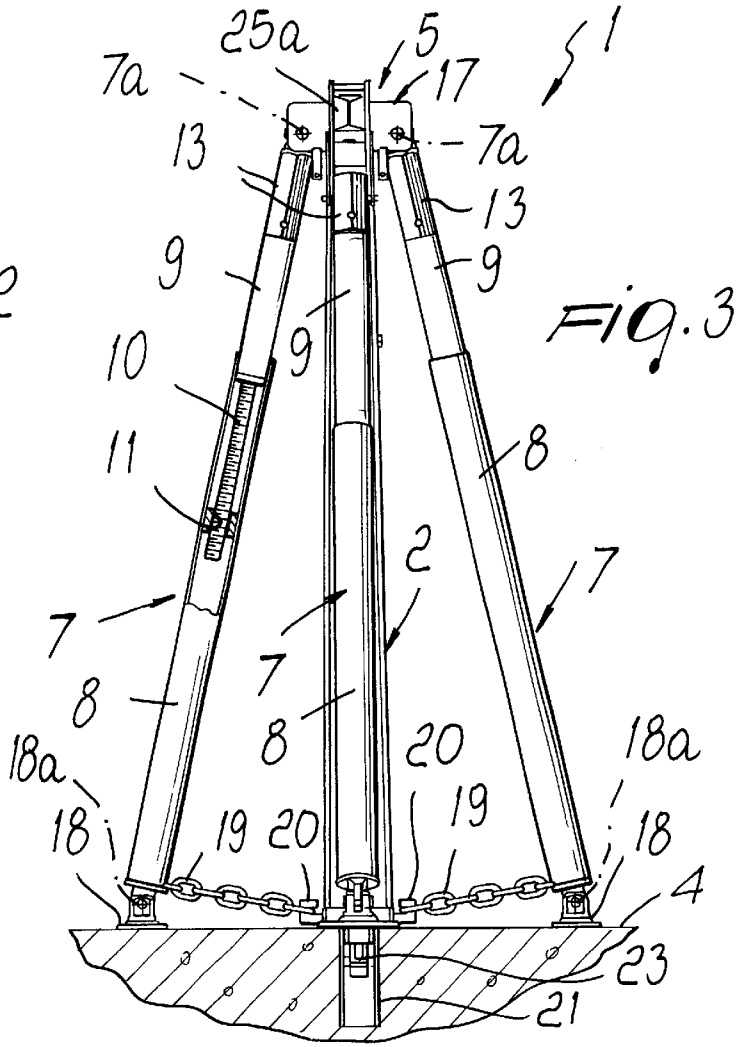
FIG. 3 is a partially sectional front elevation view of the device, applied to a concrete component.
Figure 2:
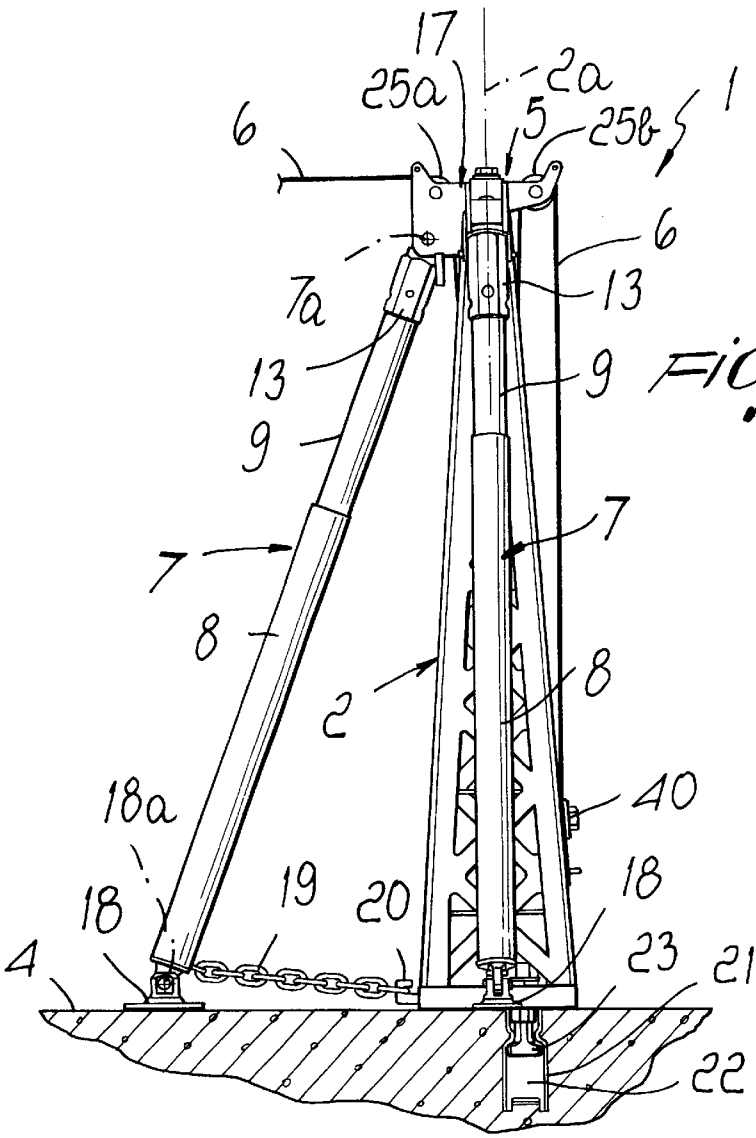
FIG. 2 is a partially sectional side elevation view of the device, applied to a concrete component.
Figure 5:
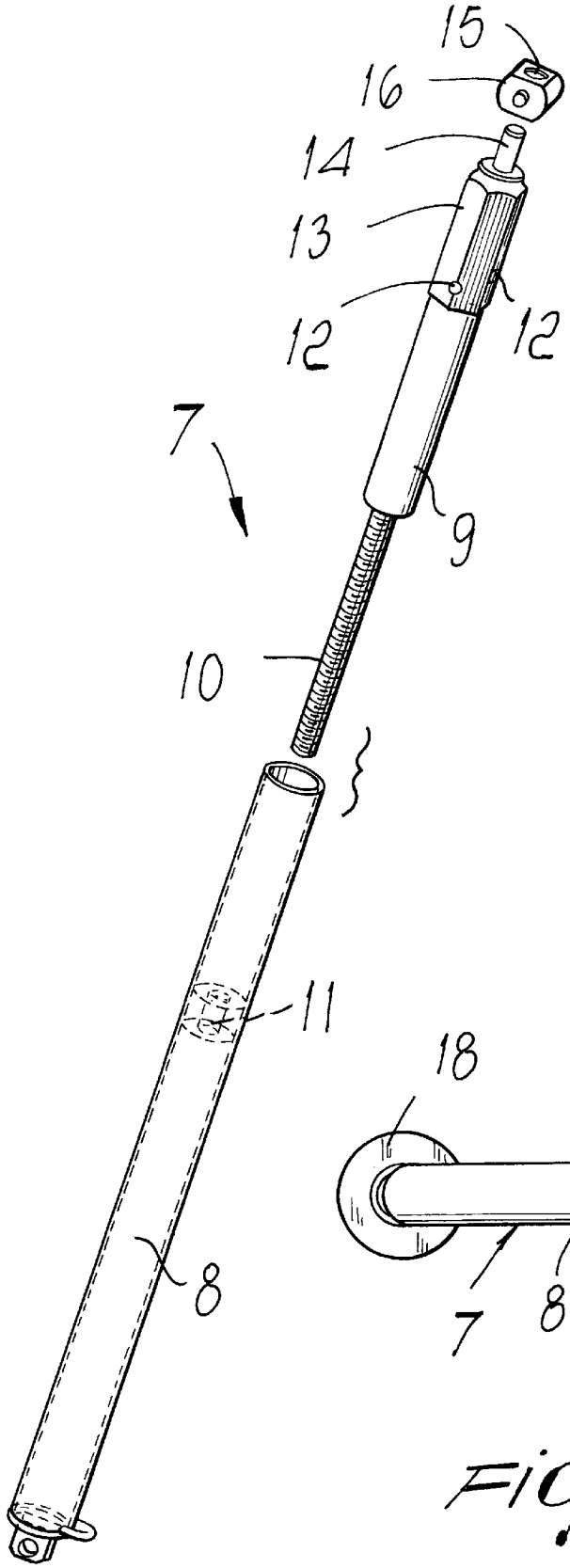
FIG. 5 is an exploded perspective view of a leg of the device according to the invention.
Figure 4:
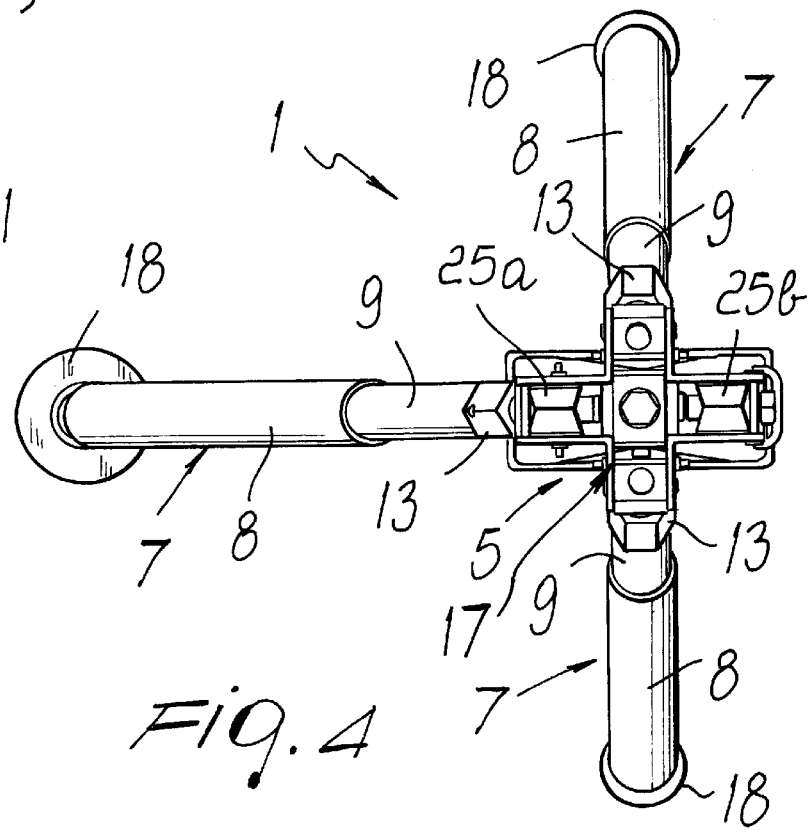
FIG. 4 is a top plan view of the device.
Figure 6:
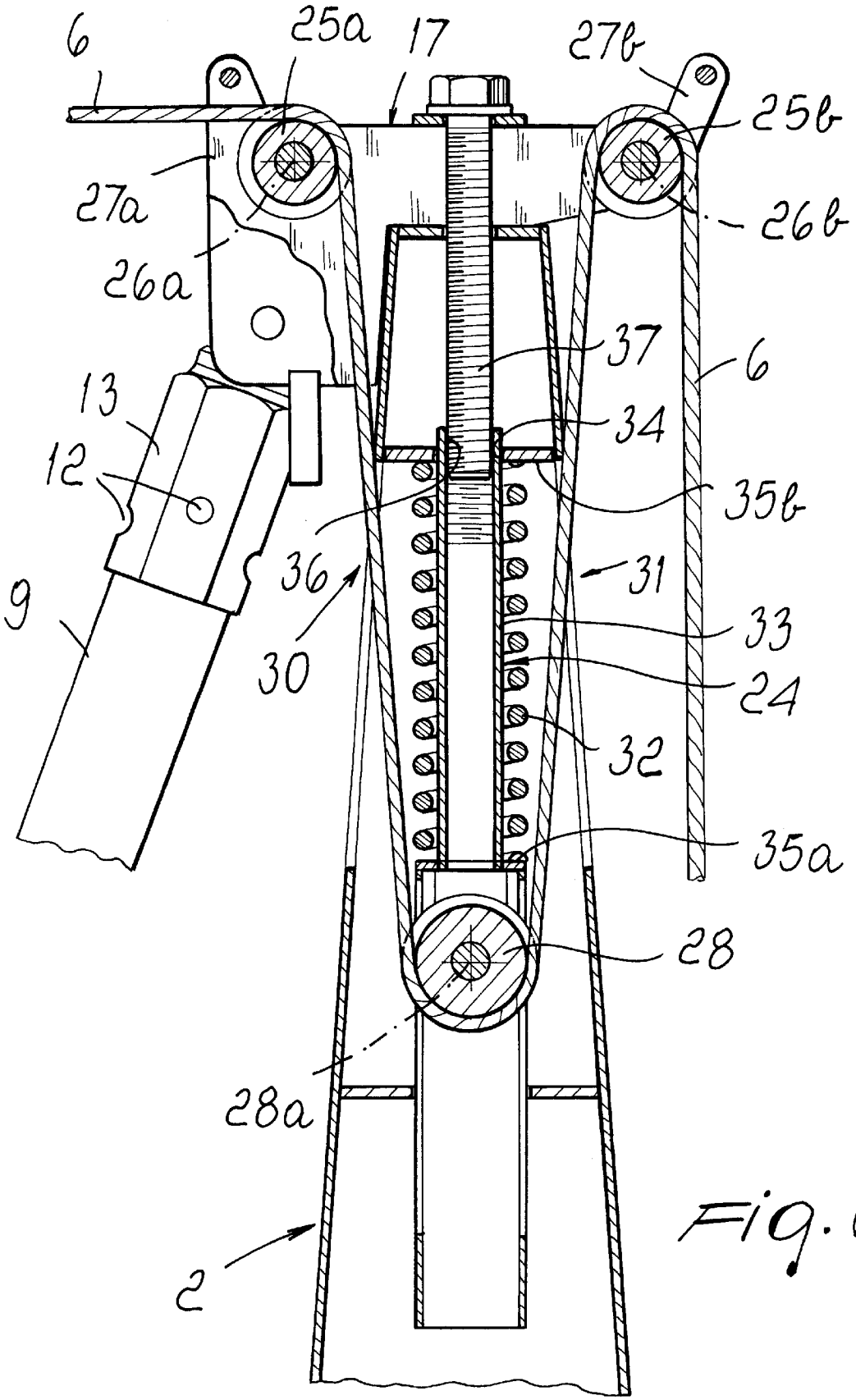
FIG. 6 is an axial sectional view of the top end of the pole of the device according to the invention.

With reference to the figures, the device according to the invention, generally designated by the reference numeral 1, comprises at least one pole 2 and connection means 3 for detachably associating the base of the pole 2 with the surface 4 of a building, particularly for associating the base of the pole 2 with a prefabricated concrete component which is part of the building. The pole 2 has, proximate to its top end, engagement means 5 for a cable element 6 that is suitable to form a safety parapet.

According to the invention, the device comprises at least one leg 7, which is connected laterally to the pole 2 and can rest, with its lower end, on the surface 4 of the building on which the pole 2 is arranged, laterally to the region of said surface that is engaged by the base of the pole 2, so as to form, for the pole 2, an auxiliary resting element for pushing against the surface 4 of the building.

Instead of a single leg 7, it is also possible to provide two legs 7, connected laterally to the pole 2 and arranged angularly spaced from each other, around the axis 2*a* of the pole 2; each one of these legs 7 can rest, with its lower end, on the surface 4 of the building laterally to the region engaged by the base of the pole 2 so as to form, for the pole 2, two auxiliary resting elements for pushing against the surface 4 of the building.

Preferably, the device comprises three legs 7, which are connected laterally to the pole 2 and are arranged angularly spaced from each other about the axis 2*a* of the pole, so as to form three auxiliary resting elements for the pole 2 on the surface 4, laterally to the region engaged by the pole 2. In this case, one leg 7 is arranged on a first vertical plane that passes through the cable element 6 and the other two legs are arranged on a vertical plane that is substantially perpendicular to said first plane. In particular, the leg 7, which lies on the first plane, is preferably arranged on the side of the pole 2 that is directed in the direction in which the cable element 6 runs, from the pole 2 being considered, toward a similar opposite pole 2, to which the other end of the cable element 6 is fixed.

Each one of the legs 7 is pivoted, proximate to its upper end, to the pole 2, about an axis 7*a*, which is substantially perpendicular to the axis 2*a* of the pole 2 and can open in a compass-like fashion laterally to the pole 2. The pivoting axis 7*a* is preferably arranged proximate to the top end of the pole 2.

Conveniently, each leg 7 has a variable useful length, which is preferably obtained by providing each leg 7 with a telescopic structure.

More particularly, as shown, each leg 7 comprises two elements which are telescopically mutually coupled; respectively, a first element 8, which is shaped like a hollow cylinder and partially coaxially accommodates a second element 9, which is substantially cylindrical. The second element 9 has, on its axial end that is accommodated inside the first element 8, a threaded shaft 10, which couples to a through female thread 11 formed inside the first element 8. The second element 9 can rotate about its own axis with respect to the first element 8 so as to achieve, as a consequence of the threaded coupling between the shaft 9 and the female thread 11, an axial movement of the first element 8 with respect to the second element 9, thus achieving a variation of the overall length of the leg 7.

In order to facilitate the rotation of the second element 9 with respect to the first element 8, on the portion of the cylindrical side wall of the second element 9 that is external with respect to the first element 8 there are holes 12, which are arranged angularly spaced from each other around the axis of the leg 7 and in which it is possible to insert a lever or pin in order to turn the second element 9. For the same reason, a portion 13 of the cylindrical side wall of the second element 9, which is external with respect to the first element 8, can be conveniently shaped like a hexagonal prism in order to allow to turn it by means of a wrench.

The upper end of the second element 9, which protrudes upward from the first element 8, has a pivot 14 whose axis coincides with the common axis of the first element 8 and of the second element 9. Said pivot 14 couples, so that it can rotate about its own axis, inside a seat 15 formed in a block 16. The pivot 14 is locked axially inside the seat 15, for example by means of an elastic ring, and the block 16 is pivoted to the pole 2 about the pivoting axis 7*a*.

A frame 17 is connected to the top end of the pole 2, and the upper ends of the legs 7 are pivoted thereto about the corresponding pivoting axes 7*a*.

Advantageously, each leg 7 has, at its lower end, a resting foot 18, which is articulated to the remaining part of the leg 7 so as to allow to orientate the resting foot 18 in order to adapt its resting surface to the inclination of the surface 4 of the building. In particular, the resting foot 18 is pivoted to the remaining part of the leg 7 about a pivoting axis 18*a*, which is substantially parallel to the pivoting axis 7*a*.

It should be noted that the engagement of the foot or feet 18 on the surface 4 is a simple resting contact and therefore no prior installation of anchoring elements for the feet 18 in the surface 4 is required; moreover, one is provided with the greatest freedom in positioning the feet 18.

Conveniently, means are provided for delimiting the compass-like opening angle of each leg 7 with respect to the pole 2. Said delimiting means, in the illustrated embodiment, are constituted by chains 19, which are connected, with one of their ends, to the corresponding leg 7 and can be coupled to suitable hooks 20 fixed to the pole 2 proximate to its base.

The pole 2 can be constituted by a pole of a known type used to anchor a safety cable element to the surface of a building.

Preferably, the pole 2 is constituted by the pole disclosed in the previously cited U.S. Ser. No. 09/645,560.

As disclosed in said patent application, the pole 2 is provided with engagement means 5 for the cable element 6, and said engagement means comprise guiding means for the cable element 6, which are suitable to divert, along a direction that is substantially parallel to the axis 2*a* of the pole 2, at least part of the stresses transmitted by the element 6 to the pole 2. The pole 2 is furthermore provided with means for damping the stresses transmitted by the cable element 6 to the pole 2 along a direction that is substantially parallel to the axis 2*a* of the pole 2.

The pole 2 comprises a main structure, which can be fixed detachably, by way of the above cited connection means 3, to the surface 4 of the building.

More particularly, the main structure of the pole 2 is constituted by a lattice-like box structure 39, which tapers from the bottom upward.

The connection means 3 comprise an anchoring element 21, which can be fixed to the surface 4 of the building or better still can be embedded in the prefabricated concrete component that forms said surface 4, and in which there is a female seat 22, which lies along an axis that is substantially perpendicular to the surface 4 with an access opening formed in said surface 4 of the building.

On the base of the pole 2 there is a male element 23, which is provided in the same manner described in the above cited patent application and can be inserted and locked axially inside the female seat 22 formed by the anchoring element 21.

The guiding means for the cable element 6 comprise elements for guiding the cable element 6, which form, for said cable element 6, proximate to the top end of the pole 2, a portion of a path whose component is parallel to the axis 2*a* of the pole 2.

At least one of said guiding elements is mounted on a supporting element 24, which can move with respect to the pole 2 along a direction that is substantially parallel to the axis 2*a*. The above cited damping means are interposed between the main structure of the pole 2 and the supporting element 24.

Conveniently, said guiding elements comprise two lateral pulleys 25*a* and 25*b*, which are associated with the frame 17 connected to the main surface of the pole 2 and are arranged so that their axes 26*a* and 26*b* are mutually parallel and substantially at right angles to the axis 2*a*. The axes 26*a* and 26*b* are spaced laterally in mutually opposite directions with respect to the axis 2*a*.

Preferably, the pulleys 25*a* and 25*b* are supported, so that they can rotate about their respective axes 26*a* and 26*b*, by two pairs of wings 27*a* and 27*b* of the frame 17. More particularly, there are two wings 27*a*, which are arranged side by side and support the pulley 25*a*, and two wings 27*b*, which are also arranged side by side and support the pulley 25*b*.

Said guiding elements comprise, in addition to the pulleys 25*a* and 25*b*, an intermediate pulley 28, which is arranged so that its axis 28*a* is parallel to the axes 26*a* and 26*b* of the pair of pulleys 25*a* and 25*b* and is arranged between the pulleys 25*a* and 25*b*. The intermediate pulley 28 is further spaced from the pair of pulleys 25*a* and 25*b* along a direction that is substantially parallel to the axis 2*a* in order to guide the cable element 6 from the pair of pulleys 25*a* and 25*b* to the intermediate pulley 28 along two path portions, designated by the arrows 30 and 31, which have a component that is parallel to the axis 2*a* of the pole.

The supporting element 24, on which the intermediate pulley 28 is mounted, is supported by the main structure of the pole 2 so as to allow movement along the axis 2*a* of the pole 2.

The damping means can be constituted, as shown, by a spring 32, for example a helical spring that is orientated so that its axis lies parallel to the axis 2*a*, or can be constituted by a hydraulic or pneumatic damper interposed between the main structure of the pole 2 and the supporting element 24.

The supporting element 24 is provided with a sleeve 33, whose axis preferably coincides with the axis 2*a* of the pole and is coupled, so that it can slide along its axis, to a coaxial sliding seat 34 formed in the top end of the pole 2.

The spring 32 is mounted around the sleeve 33 and engages, with one of its ends, against a shoulder 35*a* formed by the supporting element 24 and, with its other end, against a shoulder 35*b* formed in the main structure of the pole 2 around the inlet of the sliding seat 34.

It should be noted that in the end of the sleeve 33 that passes through the sliding seat 34 there is female thread 36, with which a screw 37 engages; said screw protrudes upward from a through hole provided for this purpose in the frame 17 coaxially to the sliding seat 34. By virtue of the rotation of the screw 37, it is possible to vary the distance at rest between the shoulders 35*a* and 35*b* and therefore vary the preloading of the spring 32.

The operation of the device according to the invention is as follows.

Figure 7:
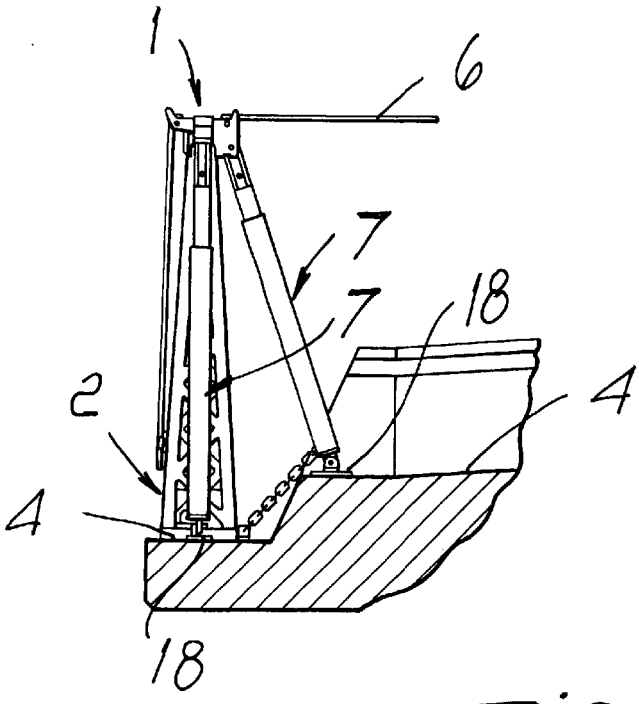
FIGS. 7 and 8 are schematic views of the use of the device with two types of prefabricated concrete component.
Figure 8:
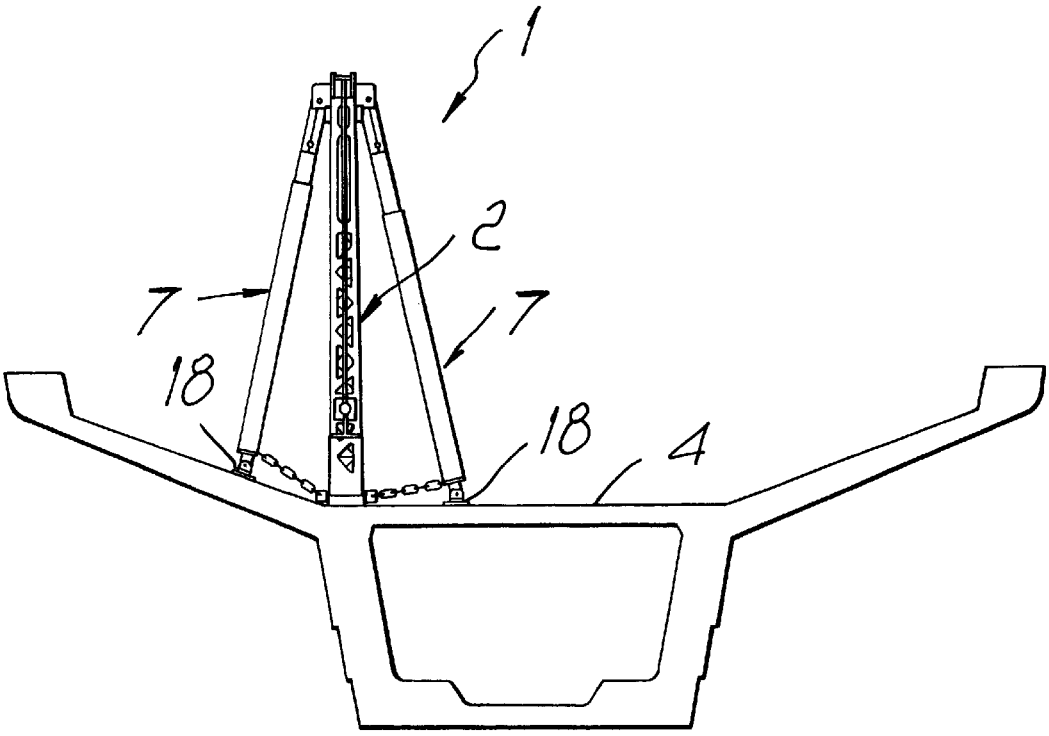
Figure 9:
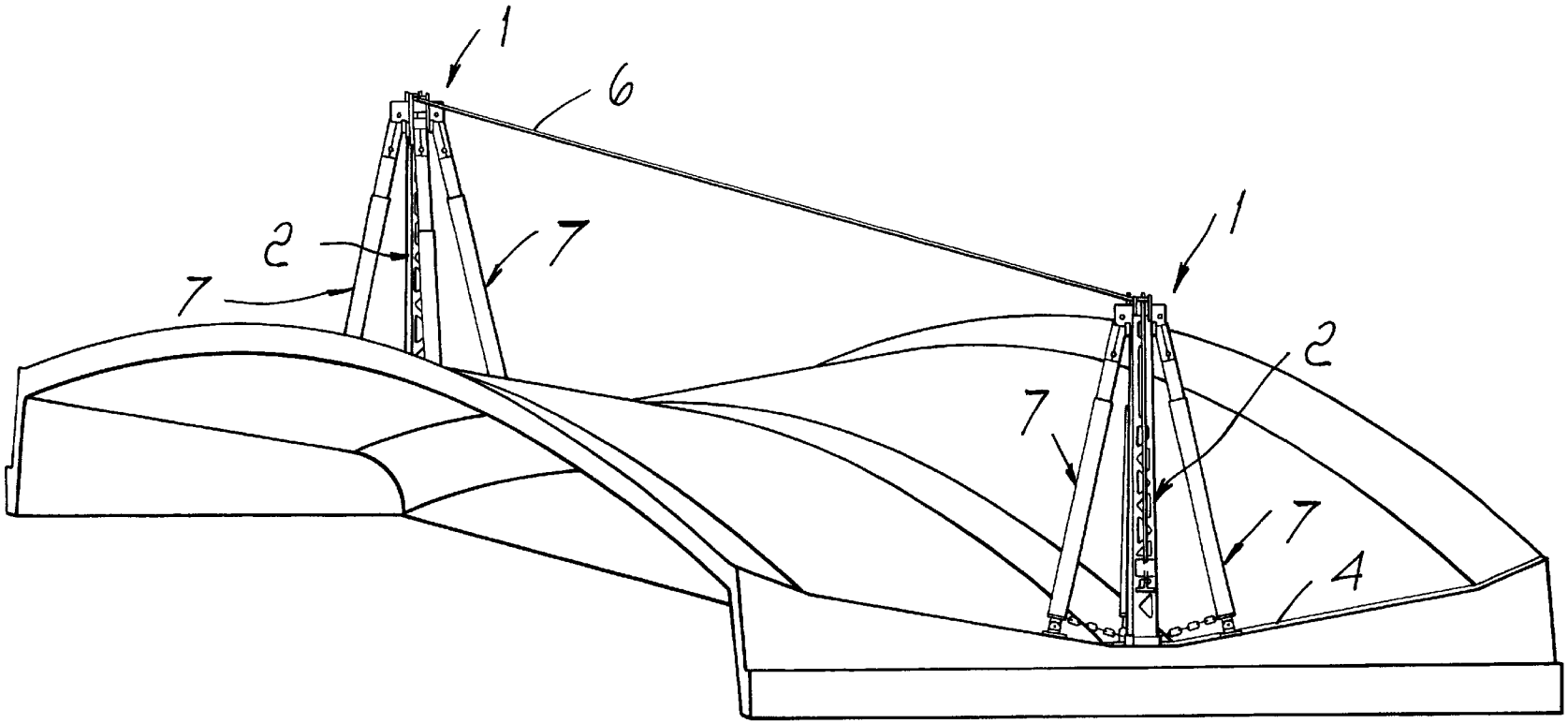
FIG. 9 is a schematic perspective view of the use of the device with another type of prefabricated concrete component.

At least two poles 2 of the device according to the invention are fixed, in two mutually spaced regions, along the surface 4 of the building, using the connection means 3 and the female seats 22 of the anchoring elements 21 provided for this purpose inside the prefabricated component that forms the surface 4 of the building. After fixing the pole 2 to the prefabricated component that forms the surface 4, the leg or legs 7 are rested on the surface 4, in regions that are spaced laterally from the region where the base of the pole 2 rests, using the possibility to vary the length of the legs 7 and the orientation of the supporting foot 18. In this manner it is possible to achieve correct resting of the feet 18 of the legs 7 on horizontal or variously inclined flat surfaces, as shown in FIGS. 7 to 9, which illustrate the application of the device according to the invention to various kinds of prefabricated slab or covering. In practice, it is possible to achieve correct resting of the legs 7 for any type of prefabricated component currently in use.

A cable element, 6 is then stretched between the two poles 2, fixing it to said poles 2, for example by means of a clamp with bolts 40, and passing it through the pulleys 25*a*, 25*b*, 28, so as to form a safety parapet to which the spring-clips of the safety belts or harnesses of workers can be anchored.

If workers accidentally fall, the forces that are discharged onto the cable element 6 and by said element onto the poles 2, thanks to the presence of the leg or legs 7, are re-centered along the axis 2*a* of the pole 2 and are discharged onto the component to which the poles 2 are anchored, without the danger of tearing out or tipping the poles even in the presence of intense forces orientated transversely to the cable element 6.

Accordingly, the spacing between the poles 2 can be considerably longer than the spacing allowed by conventional safety devices.

Furthermore, it should be noted that the forces transmitted by the cable element 6 to the pole 2 are re-centered along the axis 2*a* of the pole also due to the particular path of the cable element 6 imposed by the pulleys 25*a*, 25*b*, 28 and are also damped by the action of the spring 32.

In practice, it has been found that the device according to the invention fully achieves the intended aim, since thanks to the additional resting provided by the leg or legs to the pole, it is capable of withstanding intense forces, generated by the accidental fall of workers connected to the cable element, even if said forces are applied in regions that are considerably spaced laterally from the ideal tension line of the cable element and even if the distance between the poles that support the cable element is, due to contingent requirements, considerably greater than the distance compatible with the use of safety devices of the conventional type. Accordingly, the device according to the invention can use just two poles connected proximate to the longitudinal ends of prefabricated components of considerable length, which do not allow to install a larger number of poles and are also quite wide, such as for example most of the prefabricated slabs currently in use.

The device thus conceived is susceptible of numerous modifications and variations, all of which are within the scope of the appended claims; all the details may further be replaced with other technically equivalent elements.

In practice, the materials used, as well as the dimensions, may be any according to requirements.

What is claimed is:

1. A safety device for the building field, for individually protecting against falls workers assigned to walking at high elevations on a surface of a building under construction, comprising: at least one pole having a base and extending along an axis thereof; connection means for detachably connecting the base of said pole to the surface of a building; a cable element for forming a safety parapet; engagement means for engaging said cable element, said engagement means being provided proximate to a top end of said pole; at least one leg which is connected laterally to said pole and so as to be arrangeable to rest, with a lower end thereof, on said surface of the building, laterally to a region engaged by the base of said pole, in order to form, for said pole, an auxiliary resting element for pushing against said surface of the building, wherein said at least one of said at least one leg has a variable useful length.

2. The device of claim 1, comprising two said legs, which are connected laterally to said pole and are arranged angularly spaced from each other around the axis of the pole, each one of said legs being arrangeable to rest, with the lower end thereof, on said surface of the building laterally to the region engaged by the base of said pole in order to form, for said pole, two auxiliary resting elements for pushing against said surface of the building.

3. The device of claim 1, comprising at least three said legs, which are connected laterally to said pole and are arranged angularly spaced from each other around the axis of the pole, each one of said legs being arrangeable to rest, with the lower end thereof, on said surface of the building laterally to the region engaged by the base of said pole in order to form, for said pole, at least three auxiliary resting elements for pushing against said surface of the building.

4. The device of claim 3, wherein said at least three legs are arranged so that a first one lies on a first vertical plane that passes through the cable element and other two lie on a vertical plane that is substantially perpendicular to said first plane.

5. The device of claim 3, further comprising at least one pivoting axis arranged proximate to the top end of said pole substantially perpendicular to the axis of the pole, said at least one leg being pivoted about said pivoting axis to said pole to open, in a compass-like fashion, laterally to said pole.

6. The device of claim 5, comprising at least three pivoting axes arranged proximate to the top end of said pole, each one of said at least three legs, being pivoted to said pole, about a respective one of said three pivoting axes.

7. The device of claim 1, wherein said at least one leg has a telescopic structure.

8. The device of claim 7, wherein said at least one leg comprises a threaded coupling and at least two coaxial substantially cylindrical elements, which are mutually connected by way of said threaded coupling.

9. The device of claim 6, further comprising opening delimiting means for delimiting an opening angle of at least one of said legs opening in a compass-like fashion with respect to said pole.

10. The device of claim 9, wherein each one of said legs comprises a resting foot articulated to a lower end thereof.

11. The device of claim 1, wherein said engagement means for the cable element comprise guiding means for guiding the cable element, said guiding means redirecting, in a direction that is substantially parallel to the axis of said pole, at least part of stresses transmitted from said cable element to said pole, and wherein said pole is provided with damping means for damping the stresses transmitted from said cable element to said pole along a direction that is substantially parallel to the axis of the pole.

12. The device of claim 11, wherein said pole comprises: a main structure that is fixed detachably, through said connection means, to the surface of the building; a supporting element that is movable with respect to the main structure of the pole along a direction that is substantially parallel to the axis of the pole; said guiding means comprising guiding elements for guiding said cable element, said guiding elements being associated with said main structure of the pole and forming a path portion for said cable element proximate to the top end of the pole, said path portion having a path component that is parallel to the axis of the pole, at least one of said guiding elements being mounted on said supporting elements and said damping means being interposed between said main structure of the pole and said supporting element.

13. A safety device for the building field, for individually protecting against falls workers assigned to walking at high elevations on a surface of a building under construction, comprising; at least one pole having a base and extending along an axis thereof; connection means for detachably connecting the base of said pole to the surface of a building; a cable element for forming a safety parapet; engagement means for engaging said cable element, said engagement means being provided proximate to a top end of said pole; at least one leg which is connected laterally to said pole and so as to be arrangeable to rest, with a lower end thereof, on said surface of the building, laterally to a region engaged by the base of said pole, in order to form, for said pole, an auxiliary resting element for pushing against said surface of the building, wherein said engagement means for the cable element comprise guiding means for guiding the cable element, said guiding means redirecting, in a direction that is substantially parallel to the axis of said pole, at least part of stresses transmitted from said cable element to said pole, and wherein said pole is provided with damping means for damping the stresses transmitted from said cable element to said pole along a direction that is substantially parallel to the axis of the pole.

14. The device of claim 13, comprising two said legs, which are connected laterally to said pole and are arranged angularly spaced from each other around the axis of the pole, each one of said legs being arrangeable to rest, with the lower end thereof, on said surface of the building laterally to the region engaged by the base of said pole in order to form, for said pole, two auxiliary resting elements for pushing against said surface of the building.

15. The device of claim 13, comprising at least three said legs, which are connected laterally to said pole and are arranged angularly spaced from each other around the axis of the pole, each one of said legs being arrangeable to rest, with the lower end thereof, on said surface of the building laterally to the region engaged by the base of said pole in order to form, for said pole, at least three auxiliary resting elements for pushing against said surface of the building.

16. The device of claim 15, wherein said at least tree legs are arranged so that a first one lies on a first vertical plane that passes through the cable element and other two lie on a vertical plane that is substantially perpendicular to said first plane.

17. The device of claim 15, further comprising at least one pivoting axis arranged proximate to the top end of said pole substantially perpendicular to the axis of the pole, said at least one leg being pivoted about said pivoting axis to said pole to open, in a compass-like fashion, laterally to said pole.

18. The device of claim 17, comprising at least three pivoting axes arranged proximate to the top end of said pole, each one of said at least three legs, being pivoted to said pole, about a respective one of said three pivoting axes.

19. The device of claim 15, wherein at least one of said legs has a variable useful length.

20. The device of claim 19, wherein said at least one leg has a telescopic structure.

21. The device of claim 20, wherein said at least one leg comprises a threaded coupling and at least two coaxial substantially cylindrical elements, which are mutually connected by way of said threaded coupling.

22. The device of claim 18, further comprising opening delimiting means for delimiting an opening angle of at least one of said legs opening in a compass-like fashion with respect to said pole.

23. The device of claim 22, wherein each one of said legs comprises a resting foot articulated to a lower end thereof.

24. The device of claim 13, wherein said pole comprises a main structure that is fixed detachably, through said connection means, to the surface of the building; a supporting element that is movable with respect to the main structure of the pole along a direction that is substantially parallel to the axis of the pole; said guiding means comprising guiding elements for guiding said cable element, said guiding elements being associated with said main structure of the pole and forming a path portion for said cable element proximate to the top end of the pole, said path portion having a path component that is parallel to the axis of the pole, at least one of said guiding elements being mounted on said supporting elements and said damping means being interposed between said main structure of the pole and said supporting element.

* * * * *